US011815088B1

(12) United States Patent
Avey

(10) Patent No.: US 11,815,088 B1
(45) Date of Patent: Nov. 14, 2023

(54) TENSION APPLYING ASSEMBLY FOR FLUID END

(71) Applicant: GD Energy Products, LLC, Tulsa, OK (US)

(72) Inventor: Adam Bradley Avey, Tulsa, OK (US)

(73) Assignee: GD ENERGY PRODUCTS, LLC, Tulsa, OK (US)

( * ) Notice: Subject to any disclaimer, the term of this patent is extended or adjusted under 35 U.S.C. 154(b) by 0 days.

(21) Appl. No.: 17/956,075

(22) Filed: Sep. 29, 2022

(51) Int. Cl.
*F04B 53/22* (2006.01)
*F04B 53/16* (2006.01)
*F04B 53/10* (2006.01)

(52) U.S. Cl.
CPC ..... *F04B 53/22* (2013.01); *F04B 53/10* (2013.01); *F04B 53/16* (2013.01); *F04B 53/168* (2013.01)

(58) Field of Classification Search
CPC .... F04B 39/126; F04B 53/164; F04B 53/166; F04B 53/168; F04B 53/22
See application file for complete search history.

(56) References Cited

U.S. PATENT DOCUMENTS

| | | | | |
|---|---|---|---|---|
| 7,287,460 | B2 | 10/2007 | Riley et al. | |
| 10,024,316 | B2 * | 7/2018 | Smith | F04B 53/16 |
| 10,436,193 | B1 | 10/2019 | Jahnke | |
| 10,962,001 | B2 * | 3/2021 | Nowell | F04B 53/16 |
| 11,268,507 | B2 * | 3/2022 | Chady | F04B 53/10 |
| 11,434,901 | B2 * | 9/2022 | Nowell | F04B 39/10 |
| 11,441,683 | B2 * | 9/2022 | Mullins | F16J 15/183 |
| 11,454,321 | B2 * | 9/2022 | Mullins | F04B 53/22 |
| 2011/0308967 | A1 * | 12/2011 | Byrne | C23F 13/06 204/196.15 |
| 2019/0264680 | A1 | 8/2019 | Dyer | |
| 2021/0372398 | A1 | 12/2021 | Chady et al. | |
| 2022/0282720 | A1 | 9/2022 | Foster et al. | |
| 2022/0364645 | A1 * | 11/2022 | Mullins | F04B 53/16 |

FOREIGN PATENT DOCUMENTS

| | | | |
|---|---|---|---|
| NO | 338325 | B1 | 8/2016 |
| WO | 2021195572 | A1 | 9/2021 |

OTHER PUBLICATIONS https://www.youtube.com/watch?v=aXqiLUyL2DM, Blak Jak Liner Retention Installation Video.

* cited by examiner

*Primary Examiner* — Michael Leslie
(74) *Attorney, Agent, or Firm* — Edell, Shapiro & Finnan, LLC

(57) ABSTRACT

A tension assembly that is used with a fluid end of a reciprocating pump. The internal components of the fluid end are subject to high pressure, which negatively impacts the lifetime of any internal component. The tension assembly can be used to apply a preload to an internal component. The tension assembly includes a pair of sleeves or rings, one sleeve being coupled to the fluid end housing and the other sleeve is movable relative to the coupled sleeve. The movable sleeve engages the internal component and as that sleeve is moved inwardly toward the internal component, a force or preload is applied to the internal component, which helps set and retain it in place.

20 Claims, 9 Drawing Sheets

TENSION APPLYING ASSEMBLY FOR FLUID END

FIELD OF INVENTION

The present invention relates to the field of high-pressure reciprocating pumps and, in particular, to a device and method for applying a preload or compression to a joint in a fluid end of a high-pressure reciprocating pump.

BACKGROUND

High-pressure reciprocating pumps are often used to deliver high-pressure fluids during earth drilling operations. Reciprocating pumps include a fluid end that has a housing defining several bores or conduits formed therein. One bore is a reciprocation bore in which a plunger or piston is located and moves in a reciprocating manner. Other bores include sealing assemblies that form seals that prevent, or at least discourage, leakage from the bores or conduits to the outside of the fluid end housing.

The internal components of a fluid end of a pump encounter a substantially high pressure during operation of the pump. One such internal component is the packing located around a plunger in a fluid end intended for fracking operations. There is a need for a device that can be used to easily set an internal component in a pump, such as the packing.

SUMMARY

The present application relates to a tension assembly that is used with a fluid end of a reciprocating pump. The internal components of the fluid end are subject to high pressure, which negatively impacts the lifetime of the internal components. A packing is located around the plunger in the fluid end, and ideally is set and retained in place prior to operation of the pump. The packing is set in place by applying a preload to the packing.

The tension assembly can be used to apply the preload or compression to the packing. The tension assembly includes a pair of sleeves or rings, one sleeve being coupled to the fluid end housing and the other sleeve is movable relative to the coupled sleeve. The movable sleeve engages the packing and as that sleeve is moved inwardly toward the packing, a force or preload is applied to the packing, which helps set and retain the packing in place.

In one embodiment, a fluid end assembly of a high-pressure reciprocating pump includes a housing having a bore, and a tension assembly mountable to the housing, the tension assembly applying preload to a joint of the fluid end assembly, and the tension assembly including a locking sleeve located in the bore and threadably coupled to the housing, and a pretension sleeve threadably coupled to the locking sleeve, wherein the pretension sleeve is movable relative to the locking sleeve to adjust an amount of preload applied to the joint. In one embodiment, the housing has a first set of threads, the locking sleeve has an outer surface with a second set of threads and an inner surface with a third set of threads, the pretension sleeve has an outer surface with a fourth set of threads, the second set of threads engages the first set of threads when the locking sleeve is located in the bore, and the fourth set of threads engages the third set of threads when the pretension sleeve is inserted into the locking sleeve. In an alternative embodiment, each of the first set of threads and the second set of threads is a set of no-pitch, interrupted threads. The locking sleeve is held in a position relative to the housing by the engagement of the first set of threads with the second set of threads, the pretension sleeve is adjustable relative to the locking sleeve and the housing via the engagement of the fourth set of threads with the third set of threads. In an alternative embodiment, the position of the pretension sleeve relative to the locking sleeve determines the amount of preload applied to the joint.

In one embodiment, the fluid end assembly includes a first sealing or debris-excluding component and a second sealing or debris-excluding component, wherein each of the sealing or debris-excluding components is located between the locking sleeve and the pretension sleeve, and the first sealing or debris-excluding component and the second sealing or debris-excluding component are located near opposite ends of the engagement of the third set of threads and fourth set of threads. In an alternative embodiment, the locking sleeve includes a body with an inner surface and an outer surface opposite the inner surface, the inner surface defining a groove that is configured to engage an internal component of the joint and apply the amount of preload to the joint. In another embodiment, the locking sleeve has a body that defines a first anti-rotation element, and the fluid end assembly further includes a second anti-rotation element that is engageable with the first anti-rotation element and the fluid end housing to prevent rotation of the tension assembly relative to the fluid end housing. In another embodiment, the locking sleeve has a body and at least one handle coupled thereto, and the at least one handle is used to move the locking sleeve relative to the housing.

In an alternative embodiment, a fluid end assembly of a high-pressure reciprocating pump includes a housing having a bore, and a tension assembly coupled to the housing, the tension assembly including an outer sleeve disposed in the bore and coupled to the housing, at least part of the outer sleeve extending from the bore when the outer sleeve is coupled to the housing, and an inner sleeve located inside of the outer sleeve and coupled to the outer sleeve, wherein the inner sleeve is engageable with an internal component in the housing, and the inner sleeve is adjustable relative to the outer sleeve to apply pretension to the internal component.

In one embodiment, the inner sleeve has a body with an inner surface and an outer surface opposite the inner surface, the inner surface defines a channel through the inner sleeve, and the outer surface includes threads that are engageable with the outer sleeve. The outer sleeve includes a body that has its own inner surface and its own outer surface opposite its inner surface, the outer sleeve inner surface defines a channel through the outer sleeve, the outer sleeve inner surface includes a first set of threads that are engageable with the threads on the inner sleeve, and the outer sleeve outer surface includes a second set of threads that are engageable with threads on the housing. In addition, the second set of threads on the outer sleeve and the threads on the housing are sets of no-pitch, interrupted threads. Moreover, when the outer sleeve is held in position relative to the housing by the engagement of the second set of threads with the housing threads, the inner sleeve is adjustable relative to the outer sleeve and the housing via the engagement of the inner sleeve threads with the first set of threads on the inner surface of the outer sleeve, and the position of the inner sleeve is adjustable to provide different amounts of preload to the internal component.

In one embodiment, the invention relates to a method of applying preload to a joint in a fluid end assembly of a reciprocating pump via a tension assembly coupled to a housing having a bore, the tension assembly including an outer sleeve and an inner sleeve, and the method includes the steps of coupling the outer sleeve to the housing via the bore, coupling the inner sleeve to the outer sleeve, and applying a preload to the joint by moving the inner sleeve relative to the outer sleeve when the outer sleeve is coupled to the housing.

In an alternative embodiment, the housing has a first set of threads, the outer sleeve has an outer surface with a second set of threads and an inner surface with a third set of threads, and the inner sleeve has an outer surface with a fourth set of threads, the step of coupling the outer sleeve to the housing includes engaging the second set of threads with the first set of threads, and the step of coupling the inner sleeve to the outer sleeve includes engaging the fourth set of threads with the third set of threads. In another embodiment, each of the first set of threads and the second set of threads is a set of no-pitch, interrupted threads, and the step of coupling the outer sleeve to the housing includes inserting the outer sleeve into the bore of the housing and then rotating the outer sleeve relative to the housing so that the first set of threads engages the second set of threads.

In another alternative embodiment, the housing has a first set of threads, the outer sleeve has an outer surface with a second set of threads and an inner surface with a third set of threads, and the inner sleeve has an outer surface with a fourth set of threads, the step of applying the preload to the joint includes rotating the inner sleeve relative to the outer sleeve via the third set of threads and the fourth set of threads while the inner sleeve engages a component of the joint. In another embodiment, the inner sleeve includes a body defining a groove, and the groove of the inner sleeve engages the component of the joint during the step of applying a preload to the joint. In yet another embodiment, the method includes the step of locking the tension assembly relative to the housing via a locking pin engageable with the housing and the outer sleeve.

Other aspects of the invention will become apparent by consideration of the detailed description and accompanying drawings.

BRIEF DESCRIPTION OF THE DRAWINGS

Like reference numerals have been used to identify like elements throughout this disclosure.

DETAILED DESCRIPTION

The following description is not to be taken in a limiting sense, but is given solely for the purpose of describing the broad principles of the invention. Embodiments of the invention will be described by way of example, with reference to the above-mentioned drawings showing elements according to the present invention.

Figure 1:
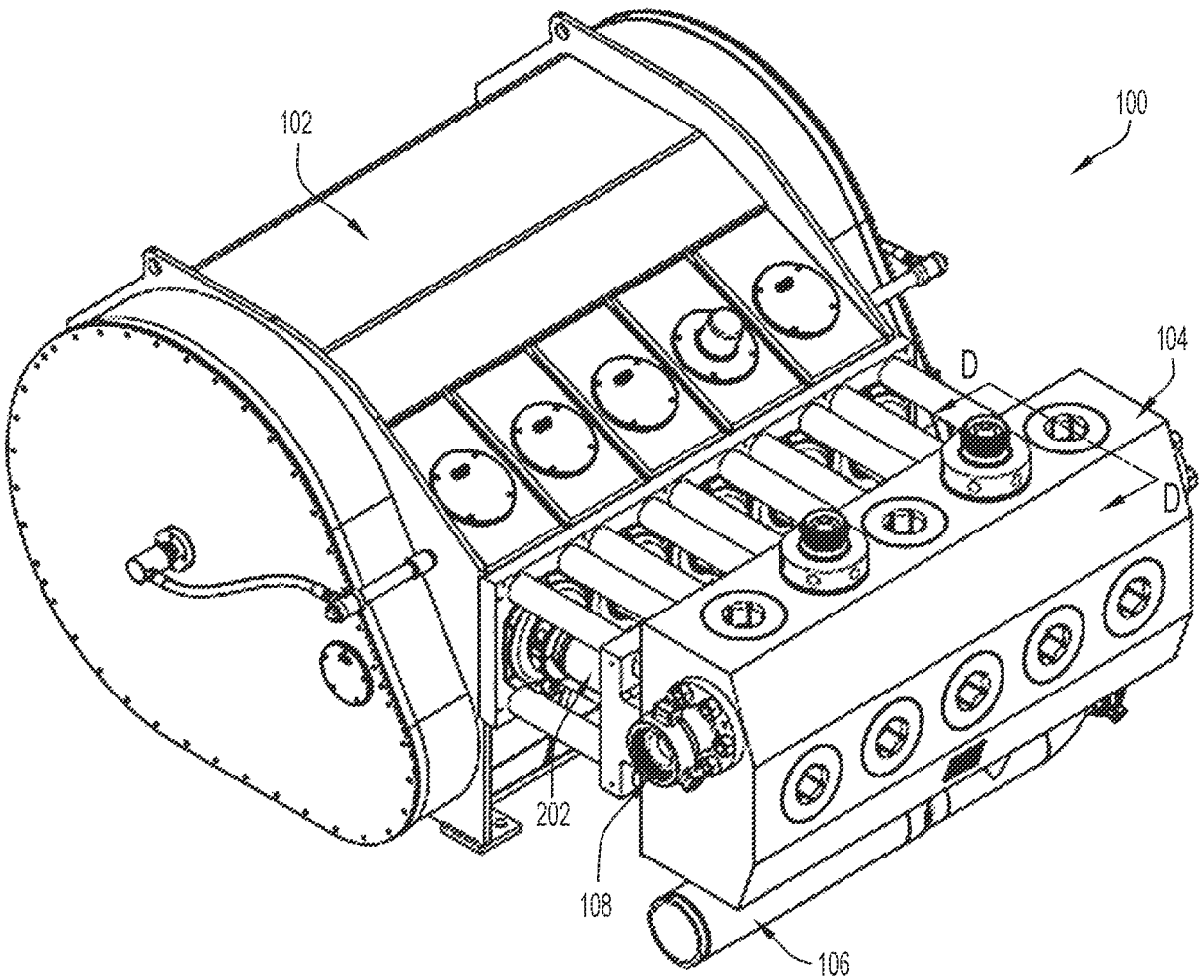
FIG. 1 is a perspective view of an embodiment of a reciprocating pump including a fluid end according to the present invention.

FIG. 1 illustrates an exemplary embodiment of a reciprocating pump or hydraulic fluid pump 100 in which the tension applying assembly disclosed herein may be included. The reciprocating pump 100 includes a power end 102 and a fluid end 104. The power end 102 includes a crankshaft (not shown) that drives a plurality of reciprocating pistons or plungers within the fluid end 104 to pump fluid at high pressure. Generally, the power end 102 is capable of generating forces sufficient to cause the fluid end 104 to deliver high pressure fluids to earth drilling operations. For example, the power end 102 may be configured to support hydraulic fracturing (i.e., fracking) operations, where fracking liquid (e.g., a mixture of water and sand) is injected into rock formations at high pressures to allow natural oil and gas to be extracted from the rock formations. However, to be clear, this example is not intended to be limiting and the present application may be applicable to both fracking and drilling operations.

Often, the reciprocating pump 100 may be quite large and may, for example, be supported by a semi-tractor truck ("semi") that can move the reciprocating pump 100 to and from a well. Specifically, in some instances, a semi may move the reciprocating pump 100 off a well when the reciprocating pump 100 requires maintenance. However, a reciprocating pump 100 is typically moved off a well only when a replacement pump (and an associated semi) is available to move into place at the well, which may be rare. Thus, often, the reciprocating pump is taken offline at a well and maintenance is performed while the reciprocating pump 100 remains on the well. If not for this maintenance, the reciprocating pump 100 could operate continuously to extract natural oil and gas (or conduct any other operation). Consequently, any improvements that extend the lifespan of components of the reciprocating pump 100, especially typical "wear" components, and extend the time between maintenance operations (i.e., between downtime) are highly desirable.

Figure 2:
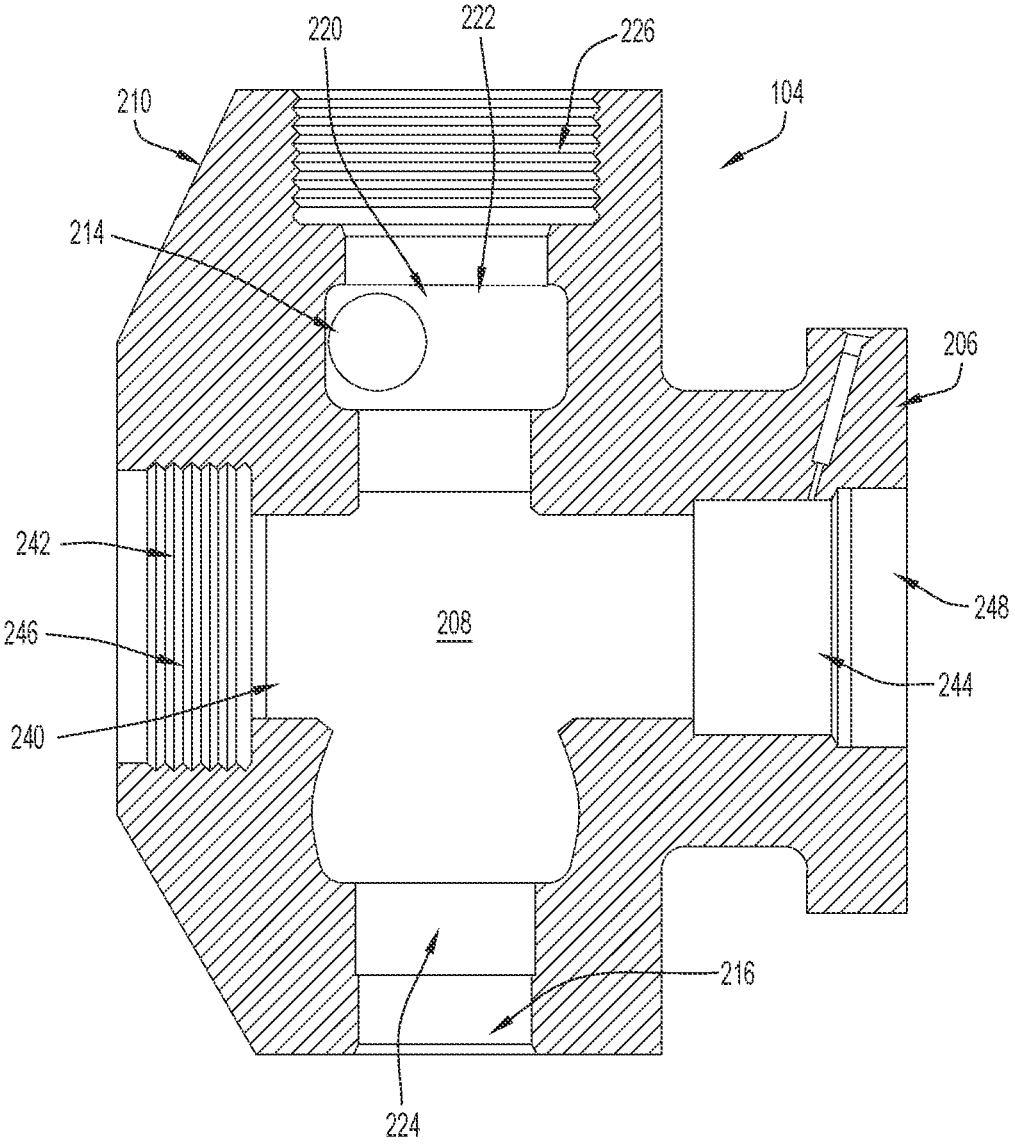
FIG. 2 is a cross-sectional view of the fluid end of the reciprocating pump illustrated in FIG. 1 taken along line D-D in FIG. 1.

FIG. 2 is a cross-sectional side view of the fluid end illustrated in FIG. 1 taken along line D-D of FIG. 1, which is representative of a central or plunger axis of one of the plungers 202 (see FIG. 1) included in reciprocating pump 100. In FIG. 2, the plunger 202 is omitted. The fluid end 104 includes a casing or housing 206 that has an external surface 210 and several pumping chambers or cross-bores 208 formed therein. Each pumping chamber 208 has a plunger 202 that reciprocates in the chamber 208. With each stroke of a plunger 202, low-pressure fluid is drawn into the pumping chamber 208 and high-pressure fluid is discharged therefrom. Often, the fluid within the pumping chamber 208 contains abrasive material (i.e., "debris") that can damage seals formed in the reciprocating pump 100.

The pumping paths and pumping chamber 208 of the fluid end 104 are formed by conduits that extend through the casing 206 to define openings at an external surface 210 of the casing 206. More specifically, a first conduit 220 extends longitudinally (e.g., vertically) through the casing 206 while a second conduit 240 extends laterally (e.g., horizontally) through the casing 206. Conduit 220 intersects conduit 240 to at least partially define the pumping chamber 208. As is illustrated in FIG. 2, the diameters of conduit 220 and conduit 240 may vary throughout the casing 206 so that the conduits can receive various structures, such as sealing assemblies or components thereof.

Regardless of the diameters of conduit 220 and conduit 240, each conduit may include two segments or bores, each of which extends from the pumping chamber 208 to the external surface 210 of the casing 206. Specifically, conduit 220 includes a bore or segment 222 on one side of the pumping chamber 208 and another bore or segment 224 that opposes bore 222 on an opposite side of the pumping bore 208. Likewise, conduit 240 includes a bore or segment 242 on one side of the pumping chamber 208 and another bore or segment 244 that opposes bore 242 on an opposite side of the pumping bore 208. In this embodiment, the segments of a conduit (e.g., bores 222 and 224 or bores 242 and 244) are substantially coaxial each other while the bores of different conduits are substantially orthogonal. However, in other embodiments, bores 222, 224, 242, and 244 may be arranged along any desired angle or angles, for example, to intersect pumping chamber 208 at one or more non-straight angles.

Still referring to FIG. 2, in this embodiment, conduit 220 defines a fluid path through the fluid end 104. Bore 224 is an intake bore that connects the pumping chamber 208 to a piping delivering fluid to the fluid end 104. Meanwhile, bore 222 is an outlet bore that allows compressed fluid to exit the fluid end 104. Thus, in operation, bores 222 and 224 may include valve components (e.g., one-way valves) that allow bores 222 and 224 to selectively open and allow fluid therethrough. However, typically, valve components in the inlet bore 224 may be secured therein by piping while valve components in outlet bore 222 may be secured therein by a sealing assembly that, for example, is secured to and seals against an interior wall of casing 206 defining segment 220.

On the other hand, conduit 240 defines, at least in part, a cylinder for plunger 202, and/or connects the casing 206 to a cylinder for plunger 202. Thus, reciprocation of a plunger 202 in or adjacent to bore 244 draws fluid into the fluid chamber 208 via inlet bore 224 and pumps the fluid out of the fluid chamber 208 via outlet bore 222. Bore 242 is an access segment that provides access to parts and surfaces disposed or defined within casing 206. However, in some embodiments, conduit 240 does not need to include bore 242 and conduit 240 may be formed as a single bore (bore 244) that extends from the pumping chamber 208 to the external surface 210.

Still referring to FIG. 2, but now in combination with FIG. 1, although FIG. 2 illustrates a single pumping chamber 208, it should be understood that a fluid end 104 can include multiple pumping chambers 208 arranged side-by-side. In some embodiments, the fluid end 104 may be modular and different casing segments may house one or more pumping chambers 208. Additionally or alternatively, multiple pumping chambers 208 may be formed in a single casing segment or casing. Regardless of how the casing 206 is formed, the one or more pumping chambers 208 included therein are arranged side-by-side so that corresponding conduits are positioned adjacent each other and generate substantially parallel pumping action.

In operation, fluid may enter fluid end 104 via multiple openings, as represented by opening 216 in FIG. 2, and exit fluid end 104 via multiple openings, as represented by opening 214 in FIG. 2. In at least some embodiments, fluid enters openings 216 via pipes of a piping system 106 (see FIG. 1), flows through pumping chamber 208 (due to reciprocation of one or more plungers 202), and then flows through openings 214 into a channel 108 (see FIG. 1). However, piping system 106 and channel 108 are merely exemplary conduits and, in various embodiments, the fluid end 104 may receive and discharge fluid via any number of pipes and/or conduits, along pathways of any desirable size or shape.

During the operation of pump 100, bore 222 of conduit 220, bore 242 of conduit 240, and bore 244 of conduit 240 may each be "closed" segments. By comparison, bore 224 (of conduit 220) may be an "open" segment that allows fluid to flow from the external surface 210 of the casing 206 to the pumping chamber 208. That is, for the purposes of this application, a "closed" segment may prevent, or at least substantially prevent, direct fluid flow between the pumping chamber 208 and the external surface 210 of the casing 206 while an "open" segment may allow fluid flow between the pumping chamber 208 and the external surface 210. To be clear, "direct fluid flow" requires flow along only the bore so that, for example, fluid flowing from pumping chamber 208 to the external surface 210 along bore 222 and channel 108 does not flow directly to the external surface 210 via bore 222.

In the embodiment illustrated in FIG. 2, bores 222, 242, and 244 include threads 226, 246, and 248, respectively, disposed adjacent the external surface 210 of the casing 206. The threads 226, 246, and 248 facilitate the coupling or mounting of components, such as valves or covers, to the fluid end 104.

Figure 3:
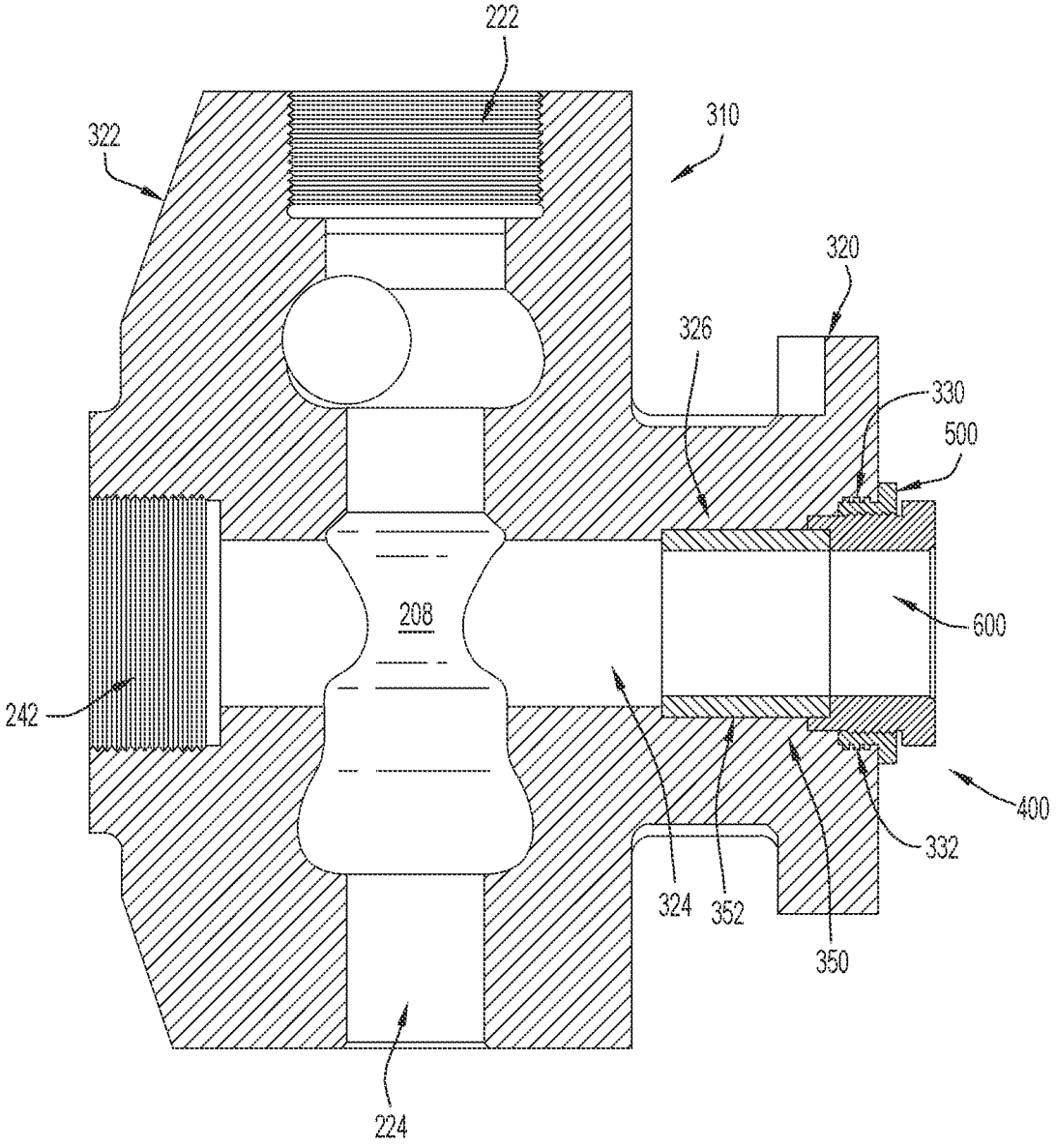
FIG. 3 is a cross-sectional view of an embodiment of a reciprocating pump with a tension applying assembly mounted thereto according to the present invention.

Referring to FIG. 3, a cross-sectional side view of an embodiment of a reciprocating pump fluid end with a tension assembly coupled thereto is illustrated. The tension assembly can be referred to alternatively as a tension applying assembly. In FIG. 3, a portion of a reciprocating or hydraulic pump fluid end is illustrated. The view of the pump fluid end or fluid end assembly 310 illustrated in FIG. 3 is taken along a line similar to the cross-sectional line D-D in FIG. 1.

Fluid end 310 includes a housing or casing 320 that has an outer surface 322. The fluid end housing 320 includes several bores, including a cross-bore 208, an inlet bore 224, an outlet bore 222, an access bore 242, and a reciprocation bore 324 (e.g., for a plunger). Bores 222, 224, 242, and 324 intersect at cross-bore 208. No components are illustrated in any of bores 222, 224, and 242 for ease of reference.

In this embodiment, the pump and the fluid end 310 includes a tension assembly or tension applying assembly 400 coupled or mounted to the housing 320. The tension assembly 400 is mounted in bore 324, which is a reciprocation bore that is defined by an inner surface 326 that defines several different sections of bore 324 that have varying diameters. Proximate the outer end of bore 324 are sets of threads 330 and 332 formed in inner surface 326, the function of which is described in greater detail below. In this embodiment, each of the sets of threads 330 and 332 includes threads that are no-pitch, interrupted threads.

Tension assembly 400 includes an outer sleeve or locking sleeve 500 that is mounted to the fluid end housing 320 via engagement with multiple sets of threads located around bore 324, including the sets of threads 330 and 332. The locking sleeve 500 is inserted into bore 324 and rotated 45 degrees to engage sets of threads 330 and 332 to couple and secure the locking sleeve 500 in place in the bore 324 and relative to fluid end housing 320.

Tension assembly 400 also includes an inner sleeve or pretension sleeve 600 that is coupled to the locking sleeve 500. The inner sleeve 600 is movable relative to locking sleeve 500 while it is coupled thereto. By being adjustable relative to the locking sleeve 500, the pretension sleeve 600 can be used to apply a preload or tension force to an internal component or joint inside of the fluid end 310 prior to use. While the locking sleeve 500 is locked in place relative to bore 324 and fluid end housing 320, the pretension sleeve 600 can be moved inwardly to compress or apply preload to a joint, such as joint 350 in FIG. 3, which includes a compression component 352, which in one embodiment is packing that surrounds a plunger (not shown).

Figure 4:
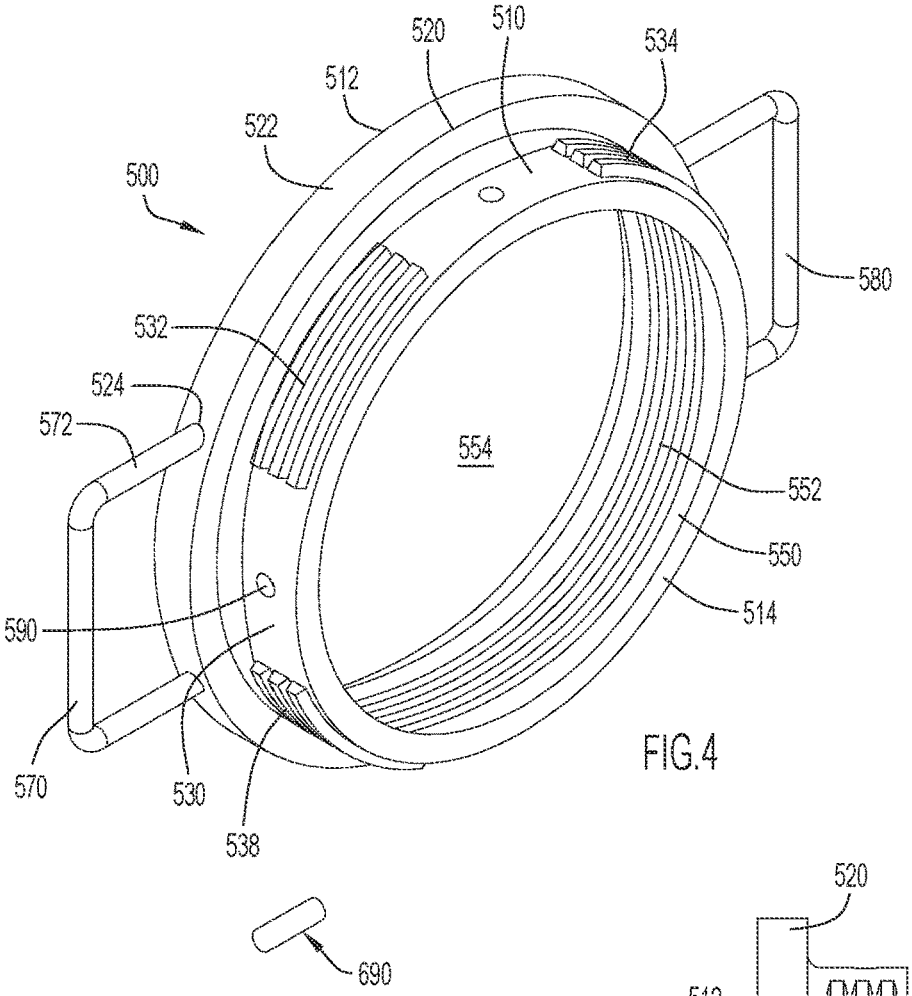
FIG. 4 is a perspective view of an embodiment of an outer or locking sleeve according to the present invention.
Figure 5:
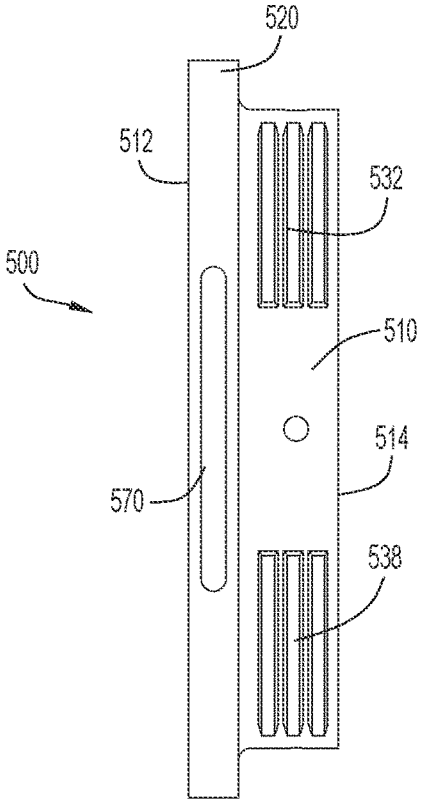
FIG. 5 is a side view of the outer sleeve illustrated in FIG. 4.

Referring to FIGS. 4-7, an exemplary embodiment of outer sleeve or locking sleeve according to the present invention is illustrated. Turning to FIG. 4, a perspective view of locking sleeve 500 is shown. The locking sleeve 500 includes a body 510 that has an outer end 512 and an opposite inner end 514. When the locking sleeve 500 is inserted into bore 324, inner end 514 is inserted into the bore 324 first, and outer end 512 is located outside of the housing 320. The body 510 has a flange portion 520 that extends outwardly radially from the body 510. When the locking sleeve 500 is inserted into bore 324, the body 510 is in the bore 324 and the flange portion 520 is outside of and, depending on the depth of the locking sleeve 500, also engages the outer surface 322 of housing 320.

Figure 6:
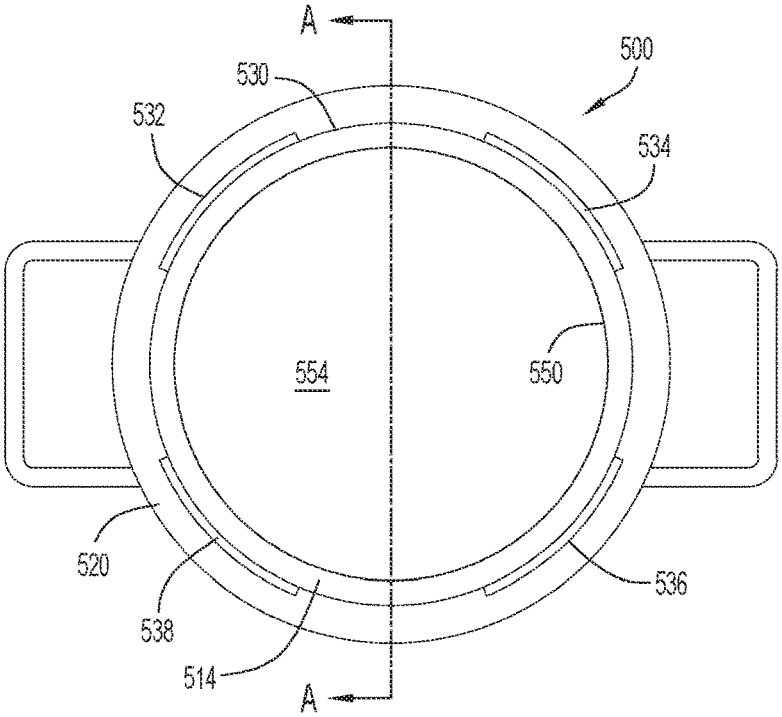
FIG. 6 is a bottom view of the outer sleeve illustrated in FIG. 4.

The locking sleeve 500 includes a pair of handles 570 and 580 coupled thereto (see FIGS. 4 and 6). The handles 570 and 580 are used to assist in installation and removal of the tension assembly 400, and in particular, the locking sleeve 500. The handles 570 and 580 can be either removably coupled to the locking sleeve 500 or secured thereto. In this embodiment, the flange portion 520 has an outer surface 522 that defines several openings 524 into which ends 572 of handle 570 are inserted. Handle 580 is similarly mounted to flange portion 520.

Referring to FIGS. 4 and 6, the body 510 of locking sleeve 500 has an outer surface 530 that has several sets of threads formed thereon. In this embodiment, locking sleeve includes four sets of threads 532, 534, 536, and 538 that are spaced apart from adjacent sets by gaps. Each of the sets of threads 532, 534, 536, and 538 includes no-pitch, interrupted threads that are configured to engage corresponding sets of no-pitch, interrupted threads formed in the inner surface 326 of bore 324, including sets 330 and 332. The locking sleeve 500 is positioned so that the thread sets 532, 534, 536, and 538 are aligned with the gaps between the sets of threads in the bore 324. The locking sleeve 500 is then inserted into the bore 324 to the desired depth, which in this embodiment is limited by the engagement of the flange portion 520 with the outer surface 326 of the housing 320, and rotated 45 degrees about its central axis so that the sets of threads 532, 534, 536, and 538 engage the sets of threads in the bore 324. As a result, the locking sleeve 500 can be locked in place in the bore 324.

Figure 7:
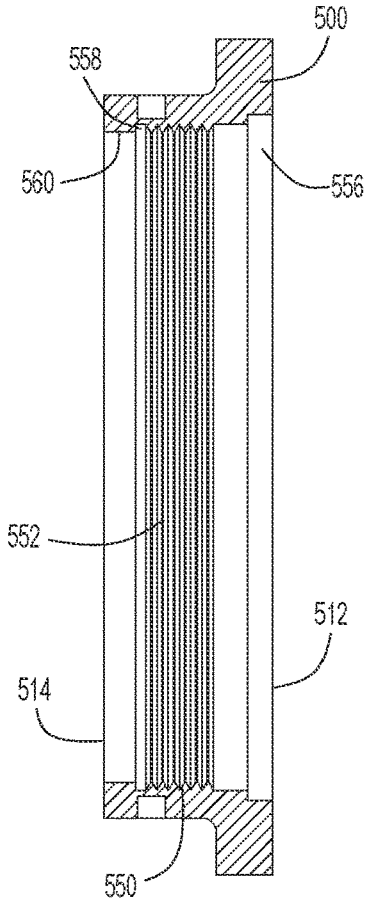
FIG. 7 is a cross-sectional side view of the outer sleeve illustrated in FIG. 6 taken along the line "A-A" in FIG. 6.

The body 510 of locking sleeve 500 has an inner surface 550, which is illustrated in FIGS. 4, 6, and 7. Referring to FIGS. 4 and 7, the inner surface 550 defines a bore or channel 554 through the locking sleeve 500. The inner surface 550 includes a set of threads 552 that extend fully around the inner surface 550. The set of threads 552 is used to couple the pretention sleeve 600 to the locking sleeve 500. At the inner end of the set of threads 552 is a groove 558 that is defined by shoulder 560 (see FIG. 7). Groove 558 is configured to receive a sealing or debris-excluding component that prevents contaminants and debris from engaging the threads 552, as described in greater detail below. At the opposite end of body 510 is an outer end groove 556 that has an inner diameter slightly larger than the inner diameter of the portion of the inner surface 550 containing threads 552.

Referring back to FIG. 4, the body 510 includes one or more anti-rotation elements, such as locking holes 590, formed therein. The locking holes 590 are configured to receive an anti-rotation element, such as a locking pin 690, that extends through a hole formed in the fluid end housing 320 and into one of the locking holes 590. As a result, unwanted rotation of the locking sleeve 500 relative to the fluid end housing 320 is prevented.

Figure 8:
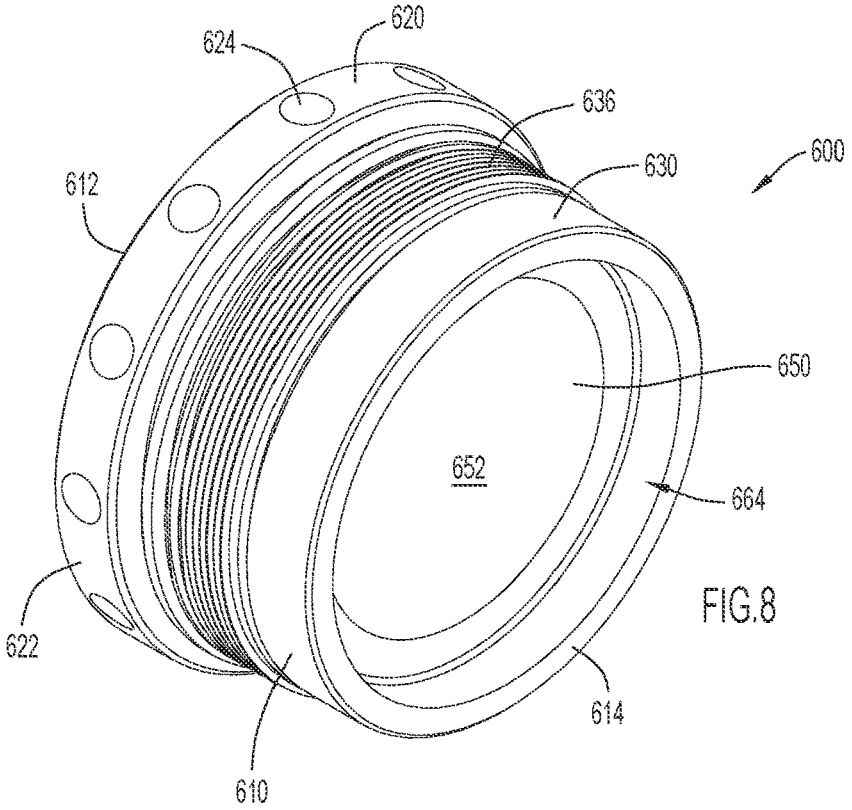
FIG. 8 is a perspective view of an embodiment of an inner or pretension sleeve according to the present invention.

Referring to FIGS. 8-11, an exemplary embodiment of an inner sleeve or pretension sleeve according to the present invention is illustrated. Turning to FIG. 8, a perspective view of pretension sleeve 600 is shown. The pretension sleeve 600 includes a body 610 that has an outer end 612 and an opposite inner end 614. When the pretension sleeve 600 is inserted into the bore 554 of locking sleeve 500, inner end 614 is inserted into the bore 554 first, and outer end 612 is located outside of the locking sleeve 500. The body 610 has a flange portion 620 that extends outwardly radially more than body 610. When the pretension sleeve 600 is inserted into bore 554, the body 610 is in the bore 554 and the flange portion 620 is outside of locking sleeve 500.

In this embodiment, the flange portion 620 has an outer surface 622 that defines several openings 624 formed therein. Openings 624 allow a user to engage the outer circumference with a tool to torque the sleeve 600 into place.

Referring to FIG. 4, the body 610 of pretension sleeve 600 has an outer surface 630 that has a set of threads 636 formed thereon. Threads 636 are configured to engage the corresponding set of threads 552 formed in the inner surface 550 of locking sleeve 500 when the pretension sleeve 600 is inserted into the bore 554 of the locking sleeve 500. By rotating the pretension sleeve 600 relative to the locking sleeve 500 after their threads are engaged, the position of the pretension sleeve 600 can be adjusted relative to the locking sleeve 500, and the extent to which the pretension sleeve 600 extends into the bore 324 of housing 320 can be adjusted. The extent that the pretension sleeve extends into the bore 324 determines the amount of preload applied to a joint in the fluid end, and in particular, to packing in bore 324.

Figure 9:
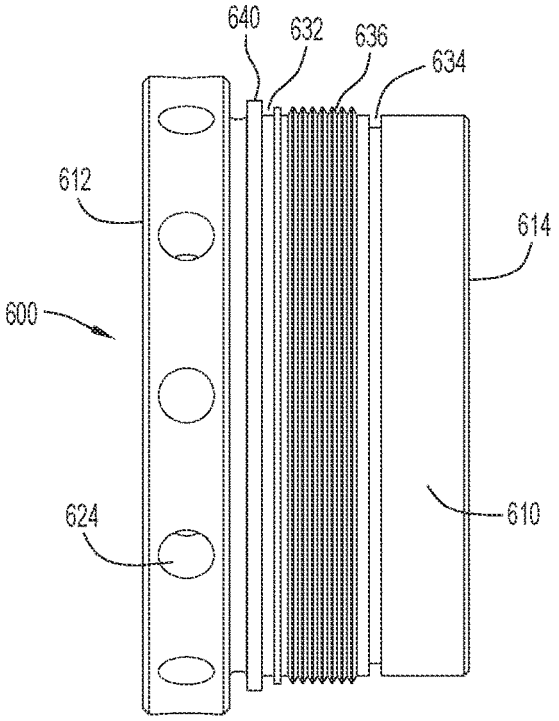
FIG. 9 is a side view of the inner sleeve illustrated in FIG. 8.
Figure 10:
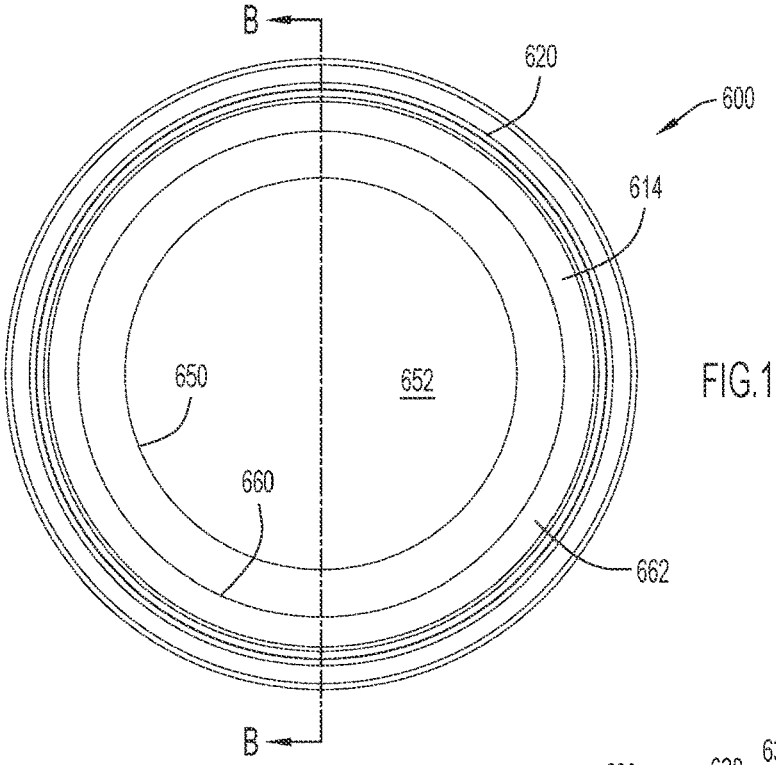
FIG. 10 is a bottom view of the inner sleeve illustrated in FIG. 8.
Figure 11:
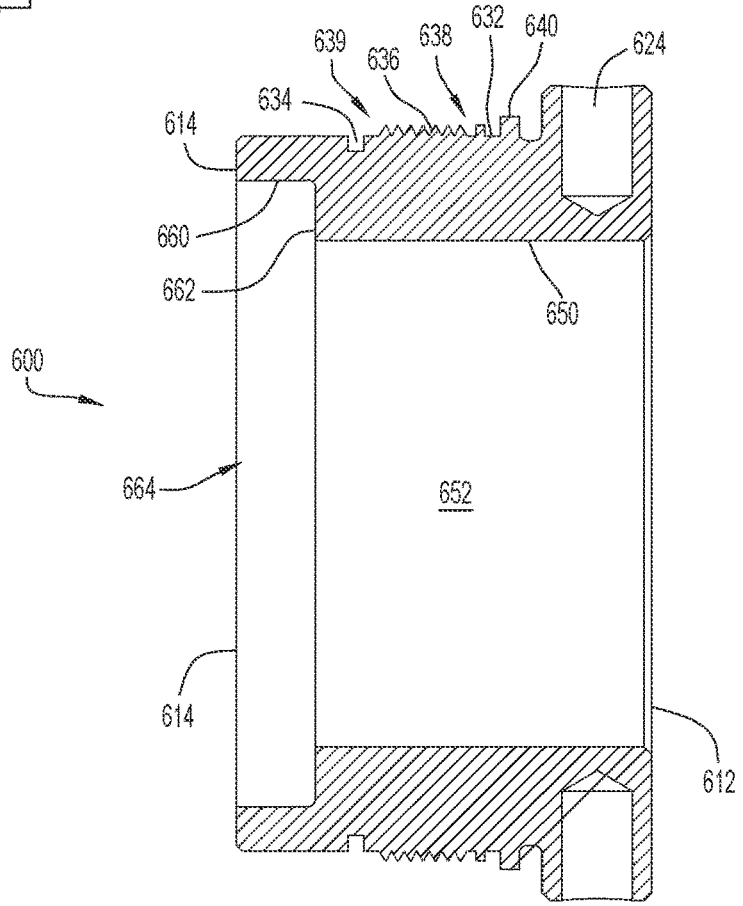
FIG. 11 is a cross-sectional side view of the inner sleeve illustrated in FIG. 10 taken along the line "B-B" in FIG. 10.

Referring to FIGS. 9 and 11, the set of threads 636 has one end 638 and an opposite other end 639, and the set extends between the ends 638 and 639. The outer surface 630 has a groove 634 formed therein proximate end 639 of threads 636. Groove 634 is configured to receive a sealing or debris-excluding component that has debris exclusion features, due to one or more of the size, shape, material, and/or location of the component. The sealing or debris-excluding component protects the threads of the sleeves as discussed herein. In addition, outer surface 630 has a shoulder or flange 640 extending outwardly radially that forms a groove 632 proximate end 638 of threads 636, which is opposite end 639. Groove 632 is sized to receive another sealing or debris-excluding component as well. The locations of the sealing or debris-excluding components are discussed in greater detail below with respect to FIG. 13. Each sealing or debris-excluding component can be any of an O-ring, a seal having any type of cross-section (circular, oval, square, rectangular, or other shape) and formed of an elastomeric material, rubber, silicone, a thermoplastic elastomer, or other similar material.

Referring to FIG. 11, the body 610 of pretension sleeve 600 has an inner surface 650 that defines a bore or channel 652 through the pretension sleeve 600. The inner surface 650 has a constant inner diameter for the majority of its length. Proximate inner end 614 is a groove 664 formed in the inner surface 650 and defined by inner surfaces 660 and 662. Groove 664 has an inner diameter that is larger than the inner diameter of the majority of the inner surface 650. The groove 664 is configured to receive part of a component internal to the fluid end housing 320. In one embodiment, the component received by groove 664 is internal component 352 forming joint 350, such as packing.

Figure 12:
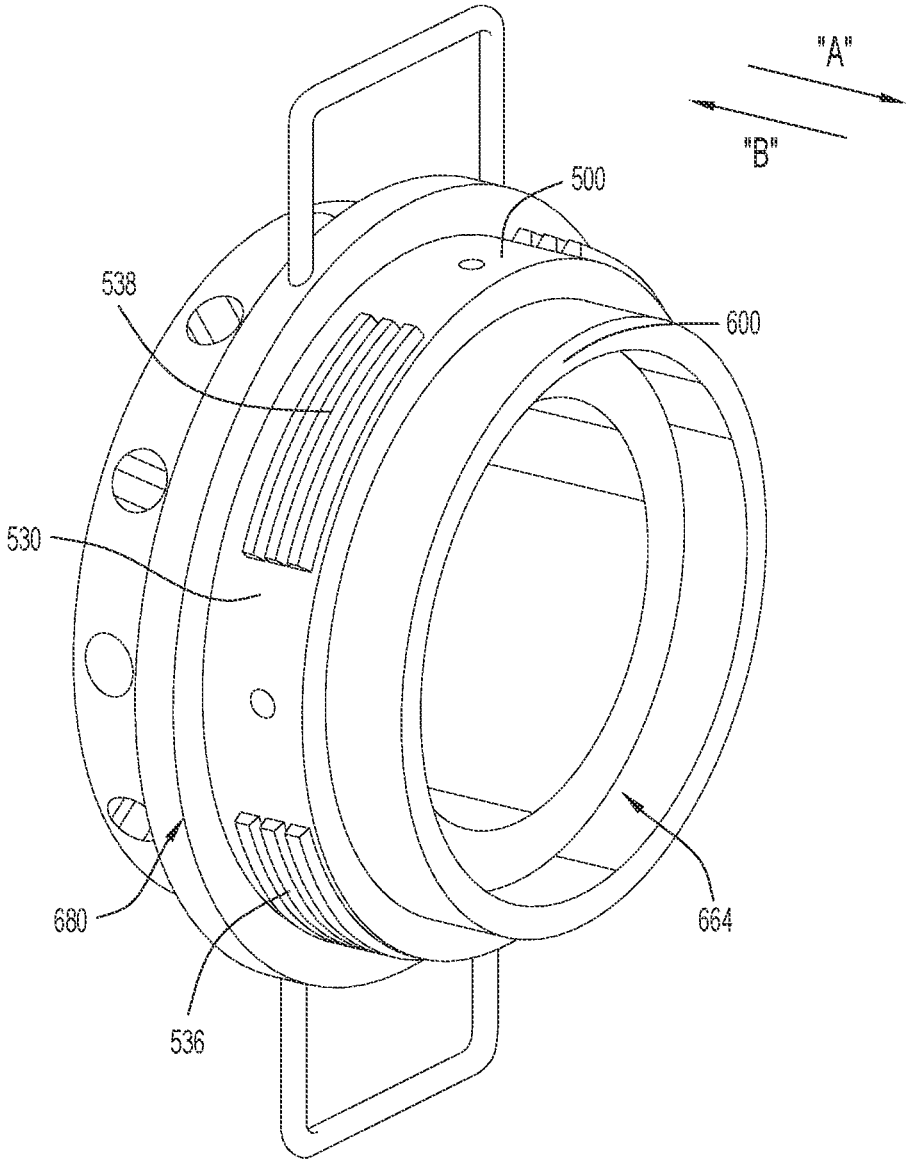
FIG. 12 is a perspective view of the inner sleeve illustrated in FIG. 8 coupled to the outer sleeve illustrated in FIG. 4.
Figure 13:
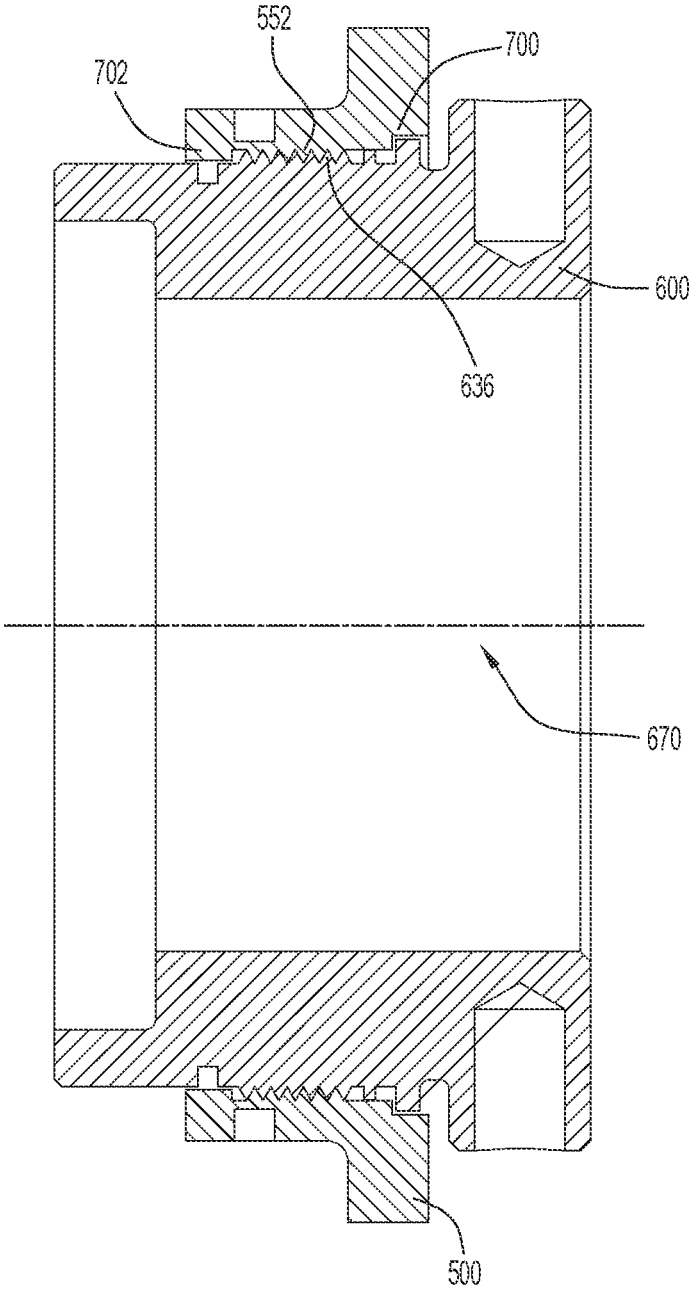
FIG. 13 is a cross-sectional side view of the inner sleeve and the outer sleeve illustrated in FIG. 12.

Turning to FIGS. 12 and 13, a perspective view and a cross-sectional side view, respectively, of the pretension sleeve 600 coupled to the locking sleeve 500 is illustrated. The pretension sleeve 600 has been inserted into the locking sleeve 500, and due to its length, the pretension sleeve 600 extends from both ends of the locking sleeve 500. The position 680 of the pretension sleeve 600 is adjustable and directly impacts the amount of pretension or preload applied to a joint.

In one embodiment, packing 352 is inserted into bore 324 of fluid end housing 320 (see FIG. 3). The locking sleeve 500 is inserted into bore 324 of fluid end housing 320 and coupled thereto, by aligning the threads with gaps and then rotating 45 degrees, as described above. The pretension sleeve 600 is inserted into the bore 554 of locking sleeve 500 and rotated clockwise to move the pretension sleeve 600 into the bore 324 along the direction of arrow "A" in FIG. 12, and into engagement with an internal component or joint of the fluid end. The groove 664 receives part of the internal component or packing 352. By rotating the pretension sleeve 600 more, the pretension sleeve 600 moves inwardly more and compresses the packing 352, thereby increasing the preload on the packing 352. A plunger is subsequently inserted through the channel 652 of pretension sleeve 600 and into bore 324, and the packing 352 surrounds the plunger. To reduce the amount of preload applied to the joint, the pretension sleeve 600 is rotated counterclockwise about its central axis 670, causing it to move along the direction of "B".

In another embodiment, the pretension sleeve 600 is inserted into and engaged with the locking sleeve 500 prior to the locking sleeve 500 being inserted into bore 324 of fluid end housing 320. The handles 570 and 572 can be used to rotate the locking sleeve 500 relative to the housing 320 for installation.

Referring to FIG. 13, the locations of the sealing or debris-excluding components 700 and 702 at opposite ends of threads 552 and threads 636 are illustrated. As mentioned above, the sealing or debris-excluding components 700 and 702 prevent undesired contaminants and debris from engaging threads 552 and 636.

While the invention has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

Similarly, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Finally, when used herein, the term "comprises" and its derivations (such as "comprising", etc.) should not be understood in an excluding sense, that is, these terms should not be interpreted as excluding the possibility that what is described and defined may include further elements, steps, etc. Meanwhile, when used herein, the term "approximately" and terms of its family (such as "approximate," etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially."

What is claimed is:

1. A fluid end assembly of a high-pressure reciprocating pump, comprising:
- a housing having a bore; and
- a tension assembly mountable to the housing, the tension assembly applying preload to a joint of the fluid end assembly, the tension assembly comprising:
  - a locking sleeve located in the bore and threadably coupled to the housing via a set of threads on an outer surface of the locking sleeve that are engageable with threads on the housing; and
  - a pretension sleeve threadably coupled to the locking sleeve, wherein the pretension sleeve is movable relative to the locking sleeve to adjust an amount of preload applied to the joint.

2. The fluid end assembly of claim 1, wherein the housing has a first set of threads, the locking sleeve has an outer surface with a second set of threads and an inner surface with a third set of threads, the pretension sleeve has an outer surface with a fourth set of threads, the second set of threads engages the first set of threads when the locking sleeve is located in the bore, and the fourth set of threads engages the third set of threads when the pretension sleeve is inserted into the locking sleeve.

3. The fluid end assembly of claim 2, wherein each of the first set of threads and the second set of threads is a set of no-pitch, interrupted threads.

4. The fluid end assembly of claim 2, wherein when the locking sleeve is held in a position relative to the housing by the engagement of the first set of threads with the second set of threads, the pretension sleeve is adjustable relative to the locking sleeve and the housing via the engagement of the fourth set of threads with the third set of threads.

5. The fluid end assembly of claim 4, wherein the position of the pretension sleeve relative to the locking sleeve determines the amount of preload applied to the joint.

6. The fluid end assembly of claim 2, further comprising:
- a first sealing or debris-excluding component; and a second sealing or debris-excluding component, wherein each of the sealing or debris-excluding components is located between the locking sleeve and the pretension sleeve, and the first sealing or debris-excluding component and the second sealing or debris-excluding component are located near opposite ends of the engagement of the third set of threads and fourth set of threads.

7. The fluid end assembly of claim 1, wherein the locking sleeve includes a body with an inner surface and an outer surface opposite the inner surface, the inner surface defining a groove that is configured to engage the joint and apply the amount of preload to the joint.

8. The fluid end assembly of claim 1, wherein the locking sleeve has a body that defines a locking hole, the fluid end assembly further comprising:

a locking pin that is engageable with the locking hole and the fluid end housing to prevent rotation of the tension assembly relative to the fluid end housing.

9. The fluid end assembly of claim 1, wherein the locking sleeve has a body and at least one handle coupled thereto, and the at least one handle is used to move the locking sleeve relative to the housing.

10. A fluid end assembly of a high-pressure reciprocating pump, comprising:

a housing having a bore; and a tension assembly coupled to the housing, the tension assembly comprising:

an outer sleeve disposed in the bore and coupled to the housing, at least part of the outer sleeve extending from the bore when the outer sleeve is coupled to the housing, the outer sleeve including a body that has its own inner surface and its own outer surface opposite its inner surface, and the outer sleeve outer surface includes a set of threads that are engageable with threads on the housing; and an inner sleeve located inside of the outer sleeve and coupled to the outer sleeve, wherein the inner sleeve is engageable with an internal component in the housing, and the inner sleeve is adjustable relative to the outer sleeve to apply pretension to the internal component.

11. The fluid end assembly of claim 10, wherein the inner sleeve has a body with an inner surface and an outer surface opposite the inner surface, the inner surface defines a channel through the inner sleeve, and the outer surface includes threads that are engageable with the outer sleeve.

12. The fluid end assembly of claim 11, wherein the outer sleeve inner surface defines a channel through the outer sleeve, the set of threads on the outer sleeve is a second set of threads, and the outer sleeve inner surface includes a first set of threads that are engageable with the threads on the inner sleeve.

13. The fluid end assembly of claim 12, wherein the second set of threads on the outer sleeve and the threads on the housing are sets of no-pitch, interrupted threads.

14. The fluid end assembly of claim 13, wherein when the outer sleeve is held in position relative to the housing by the engagement of the second set of threads with the housing threads, the inner sleeve is adjustable relative to the outer sleeve and the housing via the engagement of the inner sleeve threads with the first set of threads on the inner surface of the outer sleeve, and the position of the inner sleeve is adjustable to provide different amounts of preload to the internal component.

15. A method of applying preload to a joint in a fluid end assembly of a reciprocating pump via a tension assembly coupled to a housing having a bore, the housing having a first set of threads, the tension assembly includes an outer sleeve and an inner sleeve, the outer sleeve has an outer surface with a second set of threads, the method comprising the steps of:

coupling the outer sleeve to the housing via the bore by engaging the second set of threads with the first set of threads;

coupling the inner sleeve to the outer sleeve; and applying a preload to the joint by moving the inner sleeve relative to the outer sleeve when the outer sleeve is coupled to the housing.

16. The method of claim 15, wherein the outer sleeve has an inner surface with a third set of threads, and the inner sleeve has an outer surface with a fourth set of threads, and the step of coupling the inner sleeve to the outer sleeve includes engaging the fourth set of threads with the third set of threads.

17. The method of claim 16, wherein each of the first set of threads and the second set of threads is a set of no-pitch, interrupted threads, and the step of coupling the outer sleeve to the housing includes inserting the outer sleeve into the bore of the housing and then rotating the outer sleeve relative to the housing so that the first set of threads engages the second set of threads.

18. The method of claim 15, wherein the outer sleeve has an inner surface with a third set of threads, and the inner sleeve has an outer surface with a fourth set of threads, the step of applying the preload to the joint includes rotating the inner sleeve relative to the outer sleeve via the third set of threads and the fourth set of threads while the inner sleeve engages the joint.

19. The method of claim 18, wherein the inner sleeve includes a body defining a groove, and the groove of the inner sleeve engages the joint during the step of applying a preload to the joint.

20. The method of claim 15, further comprising the step of:

locking the tension assembly relative to the housing via a locking pin engageable with the housing and the outer sleeve.

* * * * *